United States Patent [19]

Bolach

[11] 4,003,577

[45] Jan. 18, 1977

[54] GAME APPARATUS

[76] Inventor: Joseph P. Bolach, 1596 Sanford, Muskegon, Mich. 49441

[22] Filed: Feb. 21, 1975

[21] Appl. No.: 551,844

[52] U.S. Cl. ..... 273/134 C; 273/134 AT; 273/134 E; 273/134 G; 273/143 R; 273/148 A

[51] Int. Cl.[2] ..... A63F 3/00

[58] Field of Search ..... 273/134, 136, 143

[56] References Cited

UNITED STATES PATENTS

| | | | |
|---|---|---|---|
| 2,239,779 | 4/1941 | Clark et al. | 273/134 AD |
| 2,476,535 | 7/1949 | Denson et al. | 273/136 Z |
| 2,595,725 | 5/1952 | Sutton | 273/136 Z X |
| 2,698,181 | 12/1954 | Kitovich | 273/143 R |
| 2,930,621 | 3/1960 | Gross et al. | 273/134 C |
| 3,367,662 | 2/1968 | Charles et al. | 273/134 AD |
| 3,759,521 | 9/1973 | Breslow et al. | 273/134 B |
| 3,817,531 | 6/1974 | King et al. | 273/134 AD X |

FOREIGN PATENTS OR APPLICATIONS

| | | | |
|---|---|---|---|
| 512,931 | 11/1930 | Germany | 273/143 R |
| 410,867 | 5/1934 | United Kingdom | 273/143 E |

*Primary Examiner*—Delbert B. Lowe
*Attorney, Agent, or Firm*—Mason, Fenwick & Lawrence

[57] ABSTRACT

Game apparatus including a game board having a layout with sequential positions defining a path along which a game member is moved in response to the random positioning of a rotary member indicator having a rotary drum mounted horizontally in an open-topped boxlike member, a table incorporating the game board and including space for cards representing each position on the game board, compartments for storing markers which are moved from position to position by the players and compartments for retaining cards representing each position moved to by the players. The objective of the game is to land on all of the possible positions on the game board with the first to collect all of the cards representing each of the positions being the winner of the game. A card holder is included for supporting the collected cards in a convenient viewing position.

5 Claims, 9 Drawing Figures

Fig-2
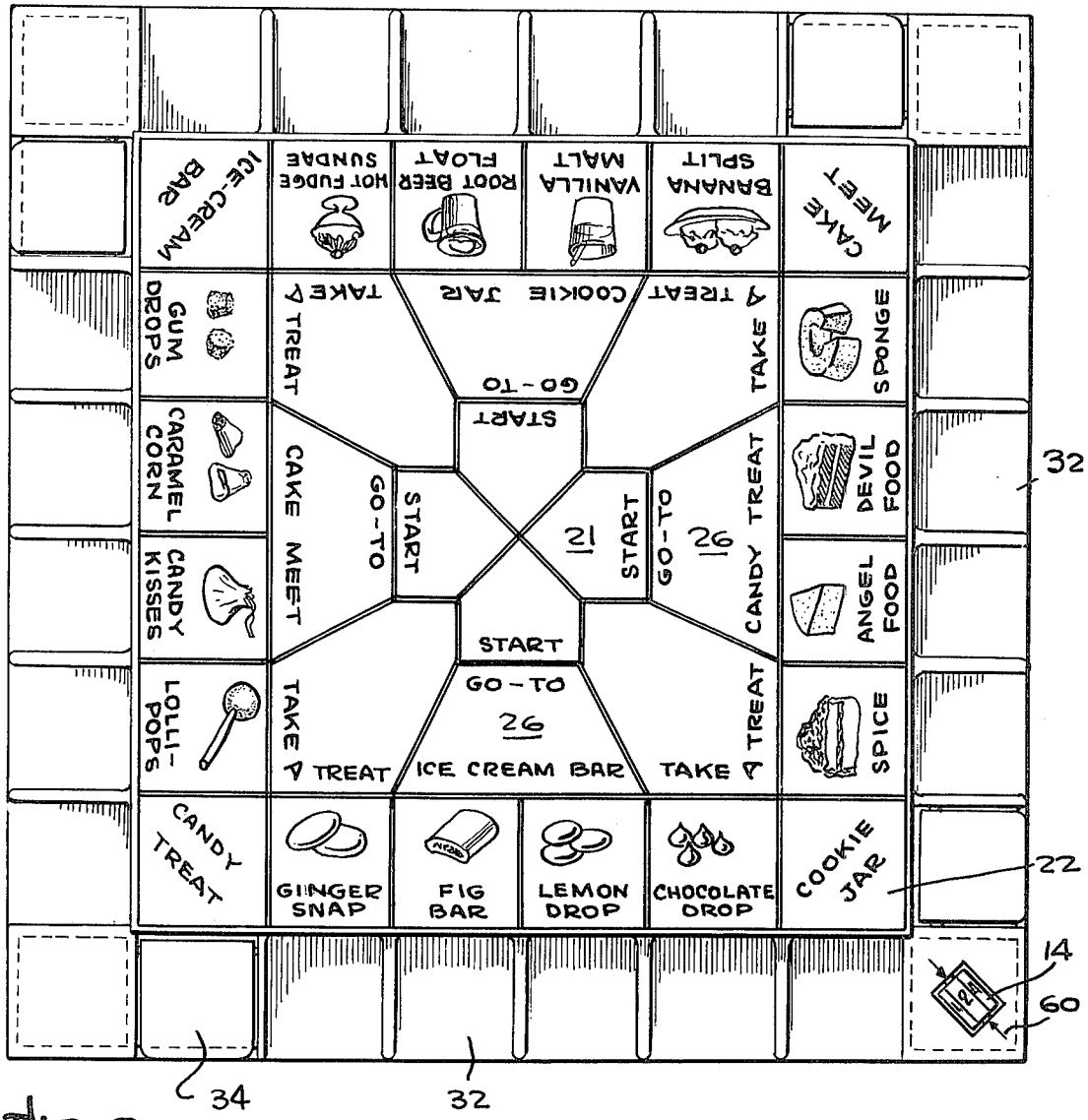
Fig-3
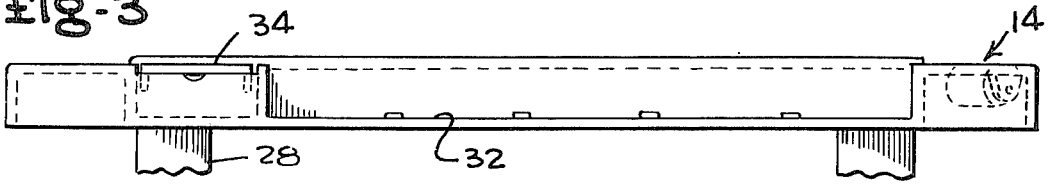
Fig-8A
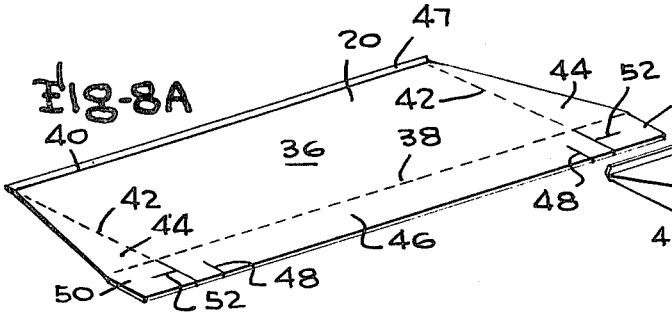
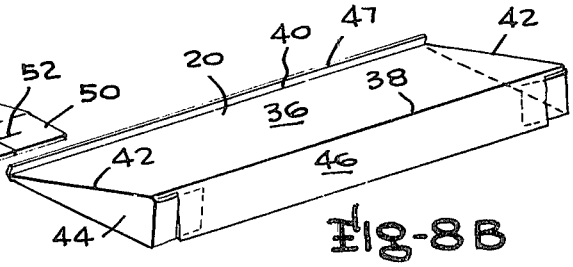
Fig-8B

GAME APPARATUS

This invention relates in general to games of chance which require skill in visualizing the possible combinations of moves to optimize the possibility of winning the game. The invention more particularly relates to a game of chance utilizing a game board, playing cards, position markers, a chance device or table for supporting the game board and a card holder for supporting the playing cards.

The present invention provides a game wherein the players collect cards representing each of the various positions on the game board on which the player landswhile moving his marker. The moves by the player are made in response to the number of moves indicated by a rotary drum chance device having a rotary cylinder with randomly distributed numbers indicated thereon. The marker is moved the indicated number of spaces shown on the rotary drum indicator when it stops after having been spun by the player. The player has an option of moving in various directions within the game rules as described herein. The present invention additionally provides a novel game board, chance means, table, and card holding device which are simple in construction, economical in cost and may be enjoyed by players of all ages.

Accordingly, it is the primary object of the present invention to provide a novel and improved game including a game board, table, chance means, and a card support device.

Another object of the present invention is to provide a game of chance which may be played by anyone, including very young children, thereby making the game appealing to persons of all ages.

An additional object of the present invention is to provide a novel chance means which is rugged in construction and can be readily incorporated into a game table.

A still further object of the present invention is to provide a game table which incorporates the gameboard and conveniently stores the accessories utilized with the game board of the present invention.

An additional object of the present invention is to provide a game which can be enjoyed by persons of all ages.

A further object of the present invention is to provide a game which requires concentration and awareness on the part of the player to make the game more challenging than a game of pure chance.

The obtainment of the objects of this invention is enabled through the provision of a game board having a lay-out defining a path along which a position marker is moved in response to the positioning of a rotary member indicator having a rotary drum mounted in an open-topped boxlike member. The rotary drum is spun by a player and has randomly distributed numbers indicated thereon while the boxlike member has an indicator which points to one of the numbers on the drum when the drum stops rotating. The obtainment of the objects of this invention is additionally enabled through the provision of a playing table having a playing surface incorporating the game board and having compartments positioned in front of each player around the periphery of the game board for retaining cards employed in the game and for retaining the position markers which are moved by the players around the path on the game board. The playing table additionally incorporates therein the rotary member indicator for determining the number of moves each player is to make. The object of the game is to land on all of the spaces of the board and collect a card representing each space on the board. The player collecting cards representing all of the spaces on the board is the winner.

Additional objects of this invention will become apparent to those versed in the art upon an understanding of the following detailed description of the game apparatus construction and play sequence in conjunction with the accompanying drawings in which a preferred embodiment of the game apparatus is shown and wherein:

FIG. 2 is a top view of the game playing table shown in FIG. 1;

FIG. 3 is a side view of the playing table shown in FIG. 1;

FIGS. 8A and 8B are perspective views of the card support device in a flattened condition for storage and in an assembled condition for use.

Figure 1:
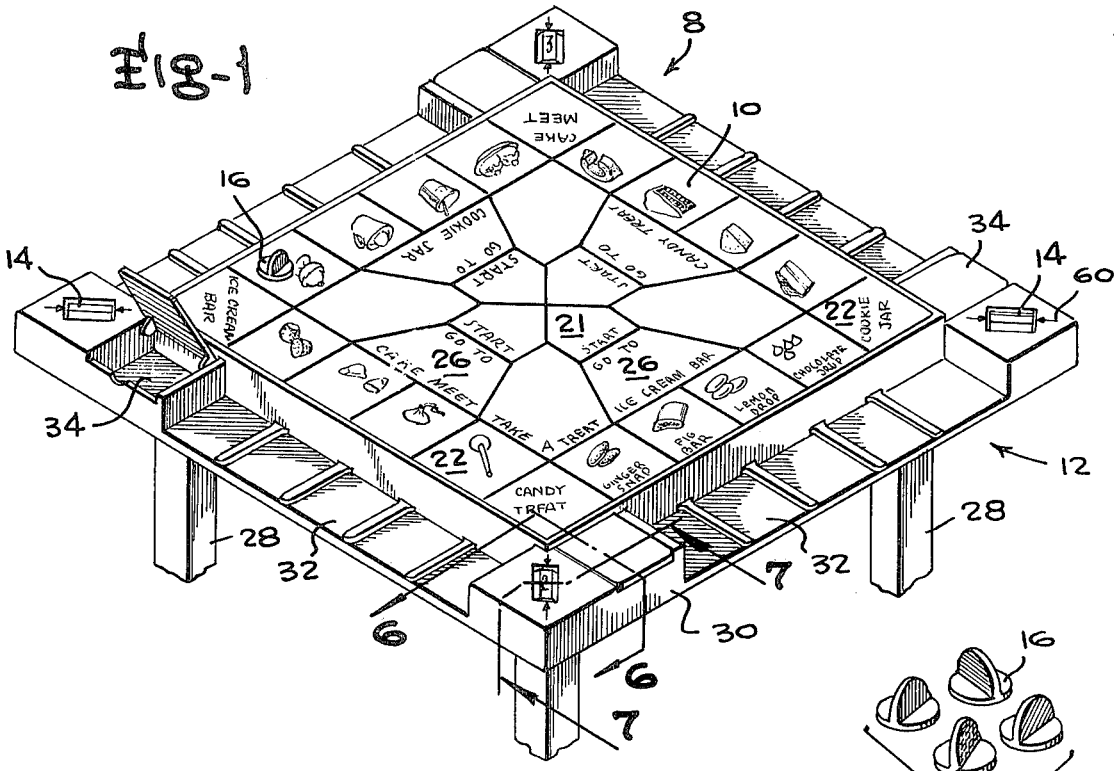
FIG. 1 is a perspective view of the game playing table, the game board, the rotary drum chance means and the storage compartments.
Figure 4:
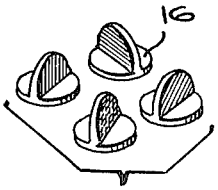
FIG. 4 is a perspective view of the position markers.
Figure 5:
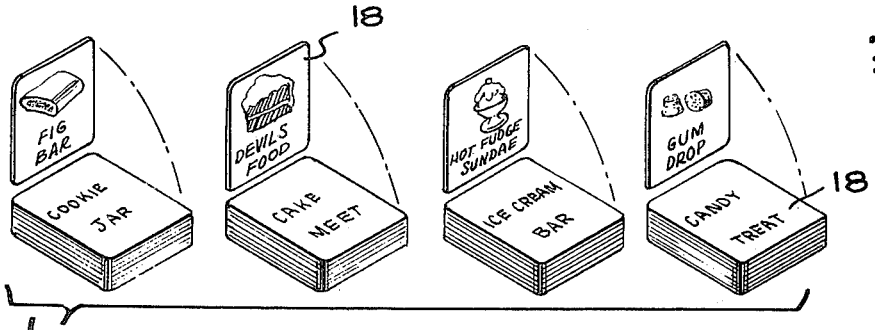
FIG. 5 is a perspective view of the cards representing the various stations on the game board.
Figure 6:
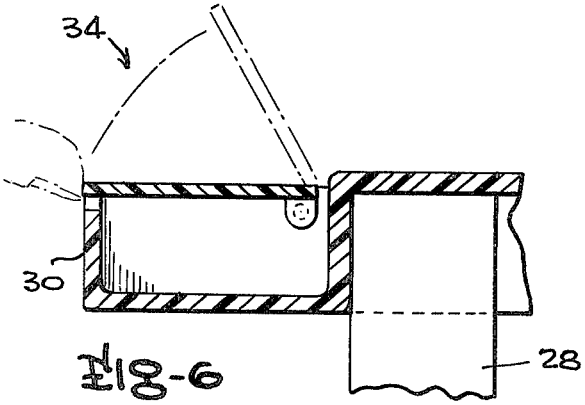
FIG. 6 is a sectional view taken along lines 6—6 of FIG. 1.
Figure 7:
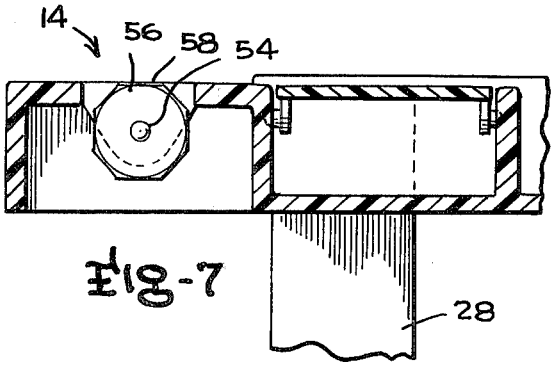
FIG. 7 is a sectional view taken along lines 7—7 of FIG. 1.

Referring now to FIG. 1, the game apparatus 8 includes a game board 10, a playing table 12, a rotating drum chance means 14, position markers 16, playing cards 18 of FIG. 5, card support devices 20 of FIG. 20 of FIG. 8B and also members 32 of FIG. 1.

The game board has a plurality of stations 22 about the periphery of the game board. The center of the game board has start positions 21 and between the start positions and the stations 22 and "GO TO" positions 26. The player, if he lands on a "GO TO" position, is directed to move to a station 22. Each of the stations 22 as illustrated in FIGS. 1 and 2 depicts a characteristic marking such as the depicted dessert type foods including such items as ginger snap, fig bar, angel food, hot fudge sundae or root beer float. These stations could be identified with any desired distinctive markings which would contribute to maintaining the interest of the players. The playing cards 18 have distinctive markings identical to those shown on the stations 22 and are in multiples at least equal to the number of players participating in the game. The maximum number of players which may conveniently play the game is limited to four which permits each of the players to have a side of the game board; however, the game board may be formed with any number of sides to accommodate as many different players as desired.

The game table of the present invention has conventional legs 28 and playing table top 30 with storage compartments 32 adjacent each side of the game board 10 when the game board is placed in a playing position on the playing table 12 as shown in FIG. 1. The storage compartments 32 provide storage areas for the sets of cards representing each of the playing stations 22. There are as many playing cards 18 for each station 22, except corners, as there are players in the game, the usual number being 4. Adjacent the compartments 32 is a card and position marker compartment 34 which provides for storage of the cards collected by the player seated on that particular side of the game table and permits storage of the position markers and the cards when the game is being stored.

A player may desire to use the card support device 20 which may be formed of pressed cardboard and folded as shown in FIG. 8B. The card support device has a rectangular center portion 36 having an upper edge 3, a lower edge 40, and two side edges 42. Triangular side members 44 are foldably attached to the side edges 42 of the rectangular main portion and are co-extensive with the side edges of the rectangular main portion. A rectangular rear support portion 46 is foldably connected to the upper edge 38 of the rectangular center portion and is co-extensive with the upper edge of the center portion. A rectangular front lip portion 47 is foldably connected to the lower edge 40 of the rectangular center portion 36 and is co-extensive with the lower edge 40. Two spaced apart back slits 48 extend inwardly from the outer edge of the rear support portion 46. Each triangular member 44 has a fold down tab 50 extending adjacent the rectangular rear portion and having side slits 52 extending outwardly from the fold down line between the triangular member and the center portion 38 whereby the side slits 52 on the fold down tabs are insertable in the back slits 48 on the rear support portion when the rear support portion and the triangular members are folded downwardly and the tabs 50 are folded inwardly. Lip portion 47 is folded upwardly to prevent cards sliding off center portion 36. The holder, therefore, provides an inclined support area for the playing cards which may be placed on the playing table or on the player's lap.

The chance device 14 as shown in FIG. 1 is incorporated in each of the four corners of the game table and the chance device includes a shaft 54 pivoted in the game table top 30. For purposes of this game, the device will be marked numerically and utilize a single drum. Mounted on the shaft is a generally cylindrical drum 56 having segments 58 distributed on the outer circumference representing the number of moves which the player is to make with his playing piece after he spins the chance device and the drum comes to a stop with a pointer 60 indicating the number of moves which the player should make. The table top 30 may be molded in a single piece of plastic material with the chance device being inserted therein. The chance device 14 may be formed separate from the table and a single device may be utilized by all of the players.

In playing the game, the object is for a player to accumulate cards representing each of the possible positions on the game board. The first player to accumulate all of the cards wins the game. Initially the game board is positioned on the playing table with players seated adjacent the respective sides of the table. The playing cards 18 are placed in the appropriate compartments 32 adjacent each of the stations 22 on the game board. The position markers, which may be of various colors, sizes and shapes, are removed from the card and markers compartments 34. Each player selects a playing piece and places it in the start position 21 closest to his side of the table. Each of the players spins the drum on one of the numerical chance devices 14 and the player receiving the highest number makes the first move, with the other players following in sequence in a clockwise direction around the game board table. The first player to move spins the drum and moves his playing piece from the start station the indicated number of spaces in any direction chosen except the player may not move back to a space he has just left or passed through in the same turn. If a player lands on a space for which a playing card is provided, a card for that space is given to the player. The player receives a card for a particular space only once regardless of the number of times he lands on that space during the game. The start position is considered as a space in any successive moves and a player may move forward, left or right from any space occupied as long as the space moved to has not been occupied by the same player in the same move. The forward direction is any direction chosen by the player and is chosen each time it is the player's turn to make a move. If a player completes the required space moves and ends up on a "GO TO", the player shall move his playing piece to the space indicated in the "GO TO" space as a part of his move. The first player to collect cards representing all of the stations on the game board wins.

Numerous modifications of the preferred embodiment will undoubtedly occur to those of skill in the art. For example the game table and game board may have as many different sides as desired for various numbers of players. In addition, it should be understood that the invention is not restricted to any particular color schemes, illustrations, or wording at the stations on the game board. The game board may have more or fewer stations, as desired, as may be true of the compartments on the game table. The chance device may be segmented any number of times and have color codes, letters, symbols, numbers, marks or signs. Each chance device may have more than one indicator and more than one drum.

Therefore, it should be understood that the spirit and scope of the invention is to be limited solely in light of the appended claims.

I claim:

1. A game apparatus comprising a game board having a plurality of sequentially arranged stations around the periphery thereof, a plurality of start positions in the center of the game board, and directive stations intermediate each start position and at least one of the sequentially arranged stations, a plurality of position markers for movement by the players along the path of movement, a plurality of game cards each identifiable with one of the stations on the path of movement, a game table with a table top for use with the game board, game cards, and position markers, said game table having an open storage compartment adjacent each of the sequentially arranged stations around the periphery of the game board when the game board is positioned on the table top, a flat surface in the center of the table top for supporting a game board, a closed storage compartment adjacent each corner of the table top and having a movable closure to permit storage of the game cards and position markers during storage of said game table, a chance device incorporated in the table top, said chance device having a rotary drum pivotally supported in a horizontal position in an opening of the table and having areas distributed around the circumference of the drum with each area identified by a number and an indicator means for pointing to the drum whereby a player may utilize the chance device by spinning the drum and observing which area the indicator means points to when the drum stops to determine the number of moves which the player should make in the particular turn.

2. A game apparatus comprising a game board having a plurality of sequentially arranged stations constituting a playing path around the periphery of the game board with each of said stations identified by a different particular category of good, a plurality of player starting positions in the center of the game board, and directive stations intermediate each start position and at least one of the sequentially arranged stations, a plurality of position markers for movement by the players along the playing path, said directive stations causing a player to move to a particular station on the periphery of the game board when a position marker lands on a directive station, a plurality of game cards each identifiable with the indicia corresponding to one of said categories of goods on said stations on the playing path, a chance device which may be utilized by a player to determine the number of moves to make in a particular turn and an open storage compartment adjacent each sequentially arranged station around the periphery of the game board to hold the game cards whereby the player first collecting a card for each station wins the game.

3. A game apparatus comprisng a game board having a plurality of sequentially arranged stations constituting a playing path around the periphery of the game board with each of said stations identified by a different particular category of goods, a plurality of player starting positions in the center of the game board, and directive stations intermediate each start position and at least one of the sequentially arranged stations, a plurality of position markers for movement by the players along the playing path, said directive stations causing a player to move to a particular station on the periphery of the game board when a position marker lands on a directive station, a plurality of game cards each identifiable with the indicia corresponding to one of said categories of goods on said stations on the playing path, a chance device which may be utilized by a player to determine the number of moves to make in a particular turn, an open storage compartment adjacent each sequentially arranged station around the periphery of the game board and a closed storage compartment adjacent each corner of the game board and having a movable closure to permit storage of the game cards and position markers during storage of same game board whereby the player first collecting a card for each station wins the game.

4. A game apparatus comprising a game board having a plurality of sequentially arranged stations constituting a playing path around the periphery of the game board with each of said stations identified by a different particular category of goods, a plurality of player starting positions in the center of the game board, and directive stations intermediate each start position and at least one of the sequentially arranged stations, a plurality of position markers for movement by the players along the playing path, said directive stations causing a player to move to a particular station on the periphery of the game board when a position marker lands on a directive station, a plurality of game cards each identifiable with the indicia corresponding to one of said categories of goods on said stations on the playing path and a chance device which may be utilized by a player to determine the number of moves to make in a particular turn, said chance means including an opening in the game board, a shaft horizontally and pivotally supported across said opening, a drum mounted on the shaft and having areas distributed about the circumference of the drum with each area identified by a visual symbol means for determining the number of moves a player should make, and an indicator means for pointing to the drum whereby a player may utilize the chance means by spinning the drum and observing which area the indicator means points to when the drum stops to determine the number of moves which the player should make in the particular turn whereby the player first collecting a card for each station wins the game.

5. The game apparatus of claim 4 wherein the indicator means is a pointer on the game board adjacent one end of the drum and parallel to the shaft.

* * * * *